US009915021B2

(12) United States Patent
Shirk

(10) Patent No.: US 9,915,021 B2
(45) Date of Patent: Mar. 13, 2018

(54) CLOTHES LINE SYSTEM WITH HORIZONTAL SYNCHRONIZED PULLEYS

(71) Applicant: George Shirk, Newmanstown, PA (US)

(72) Inventor: George Shirk, Newmanstown, PA (US)

( * ) Notice: Subject to any disclaimer, the term of this patent is extended or adjusted under 35 U.S.C. 154(b) by 0 days.

(21) Appl. No.: 15/174,565

(22) Filed: Jun. 6, 2016

(65) Prior Publication Data

US 2017/0009393 A1 Jan. 12, 2017

Related U.S. Application Data

(60) Provisional application No. 62/189,589, filed on Jul. 7, 2015.

(51) Int. Cl.

| | |
|---|---|
| ***D06F 53/00*** | (2006.01) |
| ***D06F 53/02*** | (2006.01) |
| ***D06F 53/04*** | (2006.01) |
| ***A47F 5/02*** | (2006.01) |

(52) U.S. Cl.

CPC ..... *D06F 53/04* (2013.01); *A47F 5/02* (2013.01); *D06F 53/00* (2013.01); *D06F 53/02* (2013.01)

(58) Field of Classification Search

CPC ..... D06F 53/02; D06F 53/00; D06F 53/04; D06F 57/12; D06F 57/00; A47F 5/02

See application file for complete search history.

(56) References Cited

U.S. PATENT DOCUMENTS 55,208 A 5/1866 Orberton
203,503 A * 5/1878 Sayers et al. ..... D06F 53/02 211/119.03
328,852 A * 10/1885 Lockie ..... D06F 53/02 211/119.03
510,991 A * 12/1893 Pittman ..... D06F 53/02 211/119.03
585,951 A * 7/1897 Campbell ..... D06F 53/02 211/119.03
636,510 A 11/1899 Evered
653,490 A 7/1900 Teal
701,692 A * 6/1902 Evered ..... D06F 57/12 211/94.03
845,388 A 2/1907 Alpin
1,076,121 A * 10/1913 Houck ..... A47G 25/746 211/85.3

(Continued)

*Primary Examiner* — Daniel J Troy
*Assistant Examiner* — Kimberley S Wright
(74) *Attorney, Agent, or Firm* — Miller Law Group, PLLC

(57) ABSTRACT

A clothes line system has a pair of spaced horizontal pulleys mounted respectively on support arms above the ground. Each pulley is formed with radially extending spokes having mounted on each end thereof a Y-shaped line engagement member that engages a clothes line entrained around the pulleys. The overall length of the clothes line is substantially a multiple of the linear distance between adjacent Y-shaped line engagement members on the pulleys. As a result, the Y-shaped line engagement members engage essentially the same location along the clothes line with the clothes aligning between the Y-shaped line engagement members as they pass around the pulleys. One of the pulleys maintains tension in the entrained clothes line utilizing a support arm structure that has a telescopic portion drawn toward a base member. A tilt adjustment device interconnecting the support arm and the vertical post orient the angle of the support arms.

13 Claims, 10 Drawing Sheets

(56) References Cited

U.S. PATENT DOCUMENTS

| | | | | | |
|---|---|---|---|---|---|
| 1,130,534 | A | * | 3/1915 | Pilkington | D06F 53/00 211/119.03 |
| 1,262,123 | A | * | 4/1918 | Sottile | D06F 53/02 211/119.03 |
| 1,405,073 | A | | 1/1922 | Teetor | |
| 1,451,557 | A | * | 4/1923 | Toth | D06F 53/02 188/65.1 |
| 1,481,077 | A | * | 1/1924 | Adams | D06F 53/02 211/119.09 |
| 1,497,280 | A | * | 6/1924 | Kilfoyle | D06F 53/02 254/417 |
| 1,645,334 | A | * | 10/1927 | Leggett | D06F 53/04 211/119.02 |
| 1,775,253 | A | | 9/1930 | Perebenda | |
| 1,984,274 | A | | 12/1934 | Liberett | |
| 2,424,837 | A | * | 7/1947 | Mangan | D06F 53/02 211/119.03 |
| 2,460,088 | A | * | 1/1949 | Hutchings | D06F 57/00 211/119.02 |
| 2,498,518 | A | * | 2/1950 | Zingman | D06F 57/12 211/115 |
| 2,884,138 | A | * | 4/1959 | Leo | D06F 57/12 211/95 |
| 2,907,549 | A | * | 10/1959 | Walker | D06F 53/00 16/208 |
| 4,434,898 | A | | 3/1984 | McCarthy | |
| 4,550,840 | A | | 11/1985 | Van Deursen | |
| 4,830,202 | A | | 5/1989 | Steiner | |
| 7,878,342 | B1 | * | 2/2011 | Lewis | D06F 53/00 211/119.01 |

* cited by examiner

Fig. 9
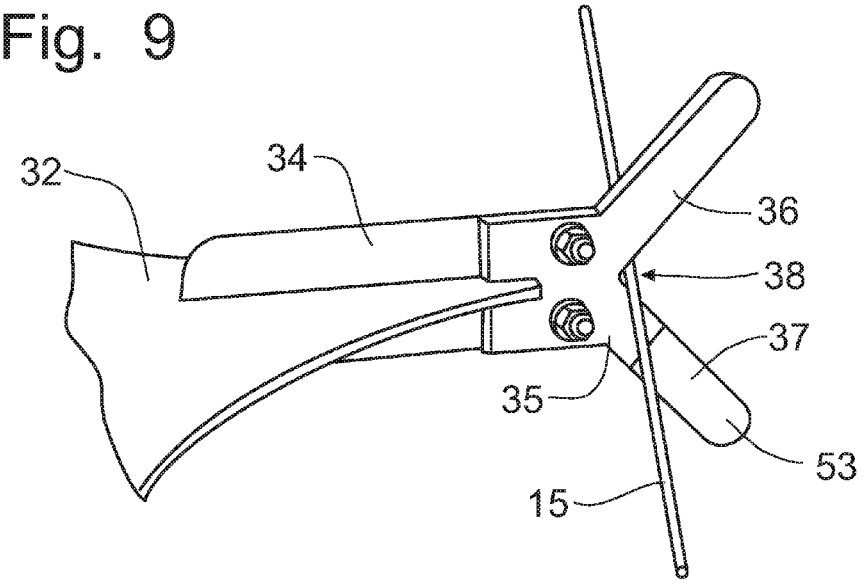
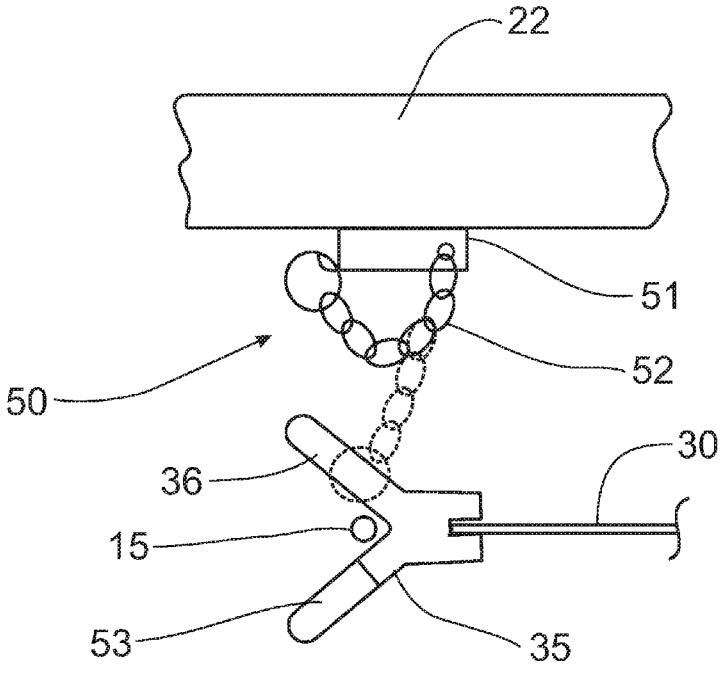
Fig. 10

CLOTHES LINE SYSTEM WITH HORIZONTAL SYNCHRONIZED PULLEYS

CROSS-REFERENCE TO RELATED APPLICATIONS

This application claims domestic priority on U.S. Provisional Patent Application Ser. No. 62/189,589, filed on Jul. 7, 2015, the content of which is incorporated herein by reference.

FIELD OF THE INVENTION

This invention relates generally to a clothes line system for hanging wet clothes for drying outside, and more particularly, to an outdoor clothes line oriented with horizontal pulleys to provide a continuous loop for hanging clothes with the opposing pulleys being synchronized to prevent interference with hanging clothes.

BACKGROUND OF THE INVENTION

Outdoor clothes lines have been used traditionally to hang wet clothes in order for the clothes to dry in the atmosphere. Conventional clothes lines are typically static structures with clothes lines extending between two spaced apart poles having cross trees mounted thereon to allow the clothes lines to be spaced horizontally a sufficient distance to allow air to move between the lines to dry the clothes, somewhat similar to the apparatus disclosed in U.S. Pat. No. 4,434,898, granted to Patrick McCarthy on Mar. 6, 1984. Such static structures typically have two to four lines extending between opposing cross trees to provide a desired amount of available lines for hanging clothes.

Clothes lines have been formed in compact structures such as is shown in U.S. Pat. No. 4,830,202, granted to Walter Steiner on May 16, 1989, in which the clothes line structure has a single pole with circumferential clothes lines supported in descending tiers to form an umbrella-type of clothes tree on which wet clothes can be hung for drying in the environment. Other similar clothes lines are shown in U.S. Pat. No. 4,550,840, granted to Aad Van Deursen on Nov. 5, 1985; U.S. Pat. No. 636,510 granted to H. C. Evered on Nov. 7, 1899; and U.S. Pat. No. 2,884,138, granted to Angelo Leo on Apr. 28, 1959.

Rotating clothes lines are also currently in use in which an endless line is entrained around a pair of vertically oriented pulleys, similar to what is shown in U.S. Pat. No. 55,208, granted on May 29, 1866 to William Orberton. Such vertically oriented pulleys allow for the clothes to be placed on the clothes line adjacent one of the pulleys and then the line is moved to play the clothes thereon outwardly from the site at which the clothes are placed onto the line. Since the vertically oriented pulleys do not have the capacity to allow clothes hung on the clothes line to wrap around the pulley to return on the upper run of the clothes line, clothes can only be placed onto the lower run of the clothes line. Furthermore, the last clothes placed onto the line will be the first clothes taken off of the line.

A number of horizontally oriented pulleys for clothes lines have been conceived over the years, including U.S. Pat. No. 1,984,274, granted to Chester Librett on Dec. 11, 1934; U.S. Pat. No. 1,775,253, granted to Frank Perebenda on Sep. 9, 1930; and U.S. Pat. No. 845,388, granted to Ralph Alpin on Feb. 26, 1907. In these various configurations of clothes lines wrapped around a pair of spaced apart horizontal pulleys, the pulleys do not incorporate structure that would appear to allow the passage of clothes already hung on the clothes line to move around the pulley. In U.S. Pat. No. 1,405,073 granted to Martin Teetor on Jan. 31, 1922, the clothes line engages a pivoted hook that has a lifting member mounted on the lower end thereof. When the dried clothes are returning to the operator at the place the clothes were hung onto the clothes line, the engagement of the clothes line with the hook causes the lifting member to raise and present the dried clothes to the operator and facilitate the removal of the dried clothes from the clothes line.

In U.S. Pat. No. 653,490, granted to Henry Teal on Jul. 1, 1900, the horizontal pulley appears to allow the passage of clothes around the pulley and, thus, enable the utilization of both runs of the clothes line; however, there is no teaching for an operation or structure that would accommodate the engagement of the clothes pins holding the clothes onto the clothes line. Furthermore, there is no teaching for the synchronization of the opposing pulley to allow clothes to wrap around the opposing pulley for a full utilization of the clothes line.

The horizontal clothes line arrangement disclosed in U.S. Pat. No. 1,497,280, granted to Fred Kilfoyle on Jun. 10, 1924, solves the problem of accommodating the clothes pins for permitting the wrapping of hanging clothes around the horizontally disposed pulleys by incorporating a suspended clothes hanging device that places the clothes lower than the pulley. In this manner, the clothes can wrap around the pulley without regard to the location of the clothes pins, and this arrangement does not require synchronization of the opposing pulleys.

It would be desirable to provide a clothes line structure that would allow the hanging of clothes onto the clothes line with conventional clothes pins that connect the clothes directly to the clothes line while allowing for the passage of the hanging clothes and the attached clothes pins to move around both of the opposing pulleys, thereby permitting a full use of both runs of the clothes line and also permitting the first clothes hung onto the clothes line to be the first clothes removed from the clothes line. In this arrangement, the driest clothes would be the first clothes removed from the revolving clothes line.

SUMMARY OF THE INVENTION

It is an object of this invention to overcome the disadvantages of the prior art by providing a clothes line system that utilizes horizontally disposed pulleys to provide two runs of clothes line between the pulleys for hanging clothes.

It is another object of this invention to provide a clothes line system that synchronizes the placement of clothes on the line for drying in a manner that the clothes will pass around both pulleys without interference.

It is a feature of this invention that each pulley is formed with plurality of Y-shaped line engagement members that engage substantially the same locations on the clothes line irrespective of the pulley.

It is an advantage of this invention that wet clothes can be hung on the clothes line at one pulley and advanced along the pulley by rotating the pulley.

It is another advantage of this invention that the wet clothes will advance down one run of the clothes line, pass around the second pulley, and return along the second run of the clothes line back to the first pulley.

It is yet another advantage of this invention that the first wet clothes hung on the clothes line system will be the first clothes removed from the clothes line system.

It is still another advantage of this invention that conventional clothes pins can be utilized to hang clothes on the clothes line system.

It is another feature of this invention that one of the pulleys is a tensioning pulley that maintains tension in the clothes line entrained around the two pulleys.

It is still another feature of this invention that the clothes lines must be constructed from a material that has little stretch in response to the tension applied to the clothes line by the tensioning pulley.

It is yet another feature of this invention that the pulleys are formed with spokes terminating in Y-shaped line engagement members that provide a linear length of clothes line between adjacent Y-shaped line engagement members to facilitate the hanging of wet clothes thereon.

It is still another object of this invention to provide a clothes line system having pulleys formed with spokes having Y-shaped line engagement members located at the end of the spokes to define a linear length of clothes line between adjacent Y-shaped line engagement members in which the overall length of the clothes line is substantially a multiple of the linear distance between adjacent Y-shaped line engagement members.

It is a further object of this invention to provide a clothes line system which is durable in construction, inexpensive of manufacture, carefree of maintenance, facile in assemblage, and simple and effective in use.

These and other objects, features and advantages are accomplished according to the instant invention by providing a clothes line system having a pair of spaced horizontal pulleys mounted respectively on support arms above the ground. Each pulley is formed with radially extending spokes having mounted on each end thereof a Y-shaped line engagement member that engages a clothes line entrained around the pulleys. The overall length of the clothes line is substantially a multiple of the linear distance between adjacent Y-shaped line engagement members on the pulleys. As a result, the Y-shaped line engagement members engage essentially the same location along the clothes line with the clothes aligning between the Y-shaped line engagement members as they pass around the pulleys. One of the pulleys maintains tension in the entrained clothes line utilizing a support arm structure that has a telescopic portion drawn toward a base member.

BRIEF DESCRIPTION OF THE DRAWINGS

The advantages of this invention will become apparent upon consideration of the following detailed disclosure of the invention, especially when taken in conjunction with the accompanying drawings wherein:

FIG. 9 is an enlarged perspective view of one of the Y-shaped line engagement members mounted at the ends of the respective pulley spokes;

FIG. 10 is an enlarged partial elevational view of the support arm for the tensioning pulley to show an elevational view of the chain latch device to latch the clothes line system to prevent movement thereof.

DETAILED DESCRIPTION OF THE PREFERRED EMBODIMENT

Figure 1:
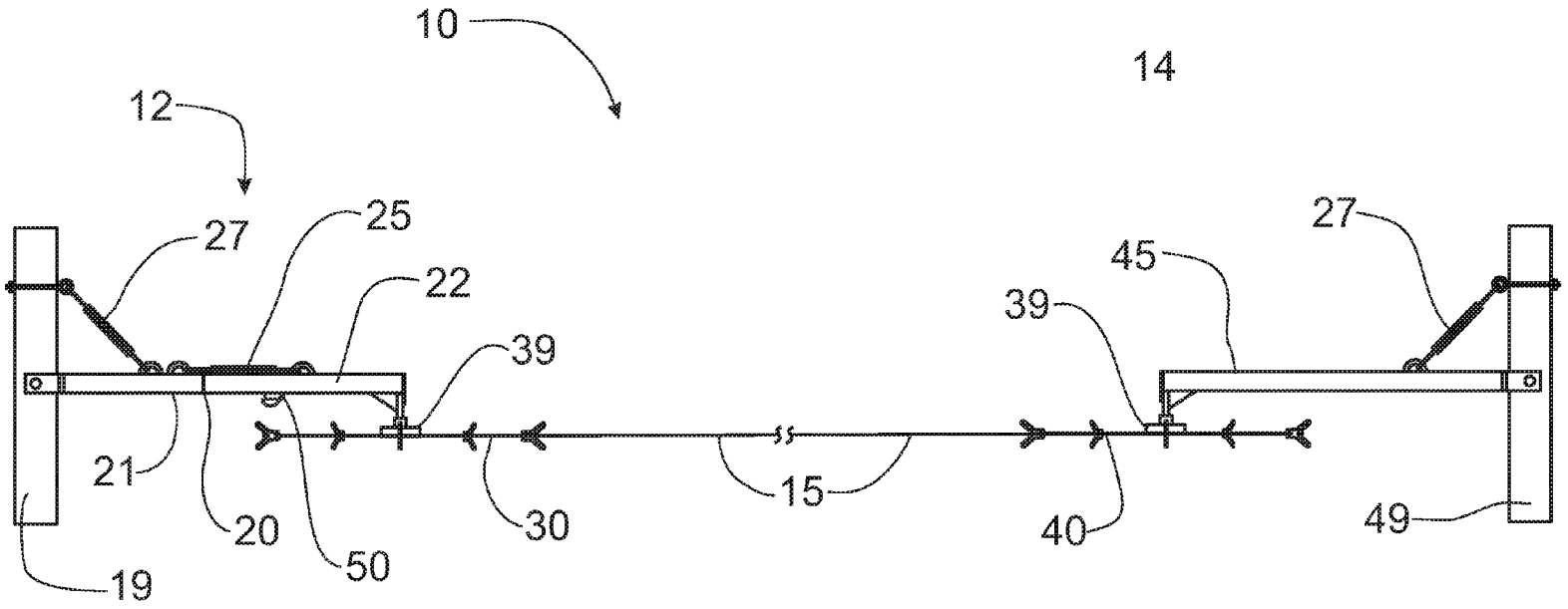
FIG. 1 is a right side elevational view of the clothes line system incorporating the principles of the instant invention, the length of the line between the horizontal pulleys being broken to reflect an indeterminate length.
Figure 2:
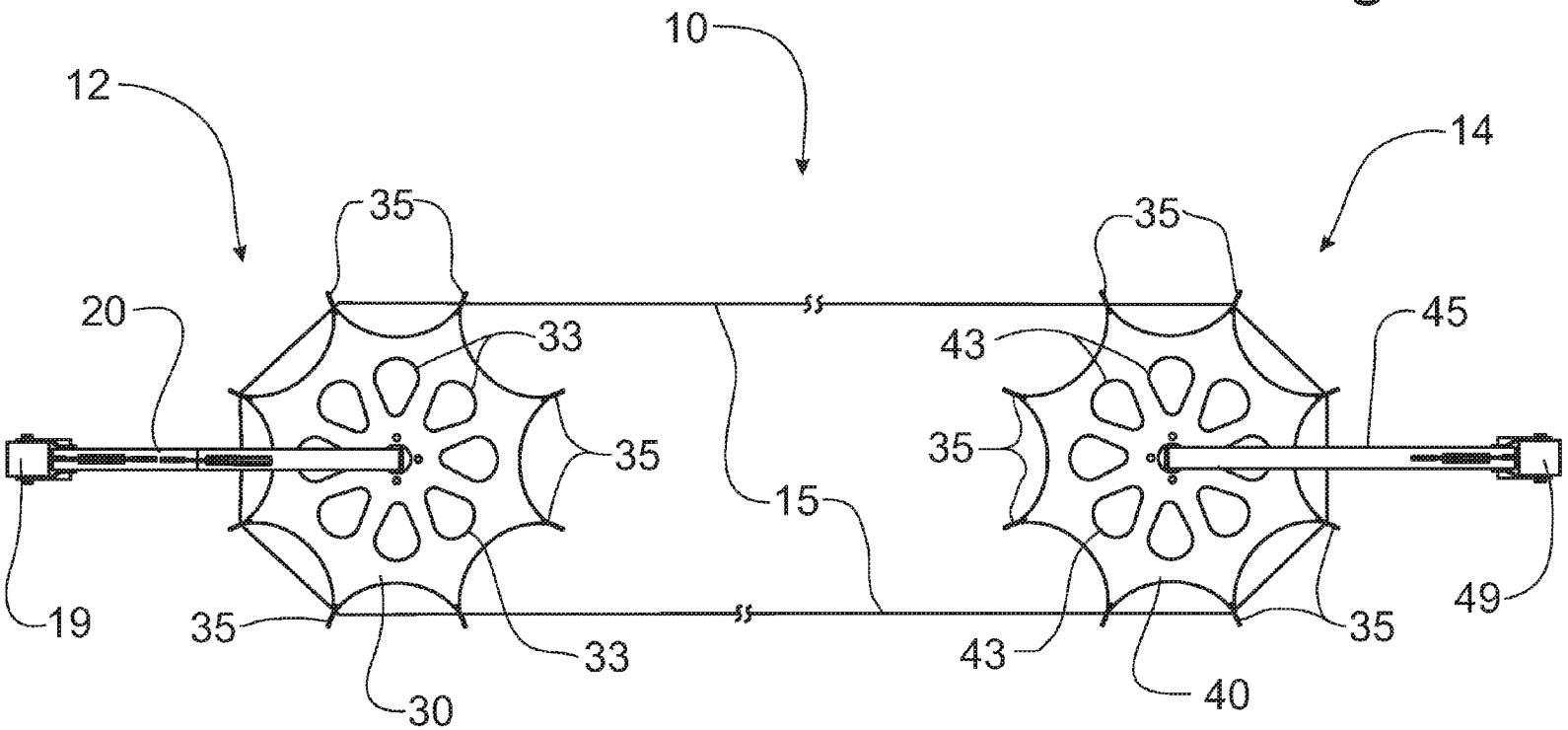
FIG. 2 is a plan view of the clothes line system depicted in FIG. 1.

Referring now to the drawings, a clothes line system, incorporating the principles of the instant invention, can best be seen. The clothes line system 10 is an elongated structure having an operating end 12 and a spaced apart return end 14 interconnected by an endless clothes line 15 that is entrained around a turning pulley 30 at the operating end 12 and a return pulley 40 at the return end 14. The distance between the operating end 12 and the return end 14 can vary according to the amount of clothes line 15 desired for the specific installation; however, as one skilled in the art will readily recognize, the overall length of the clothes line apparatus 10 has physical limitations due to the tension loading that needs to be applied to the clothes line 15 to keep the turning pulley 30 and the return pulley 40 properly synchronized, as will be described in greater detail below.

Figure 3:
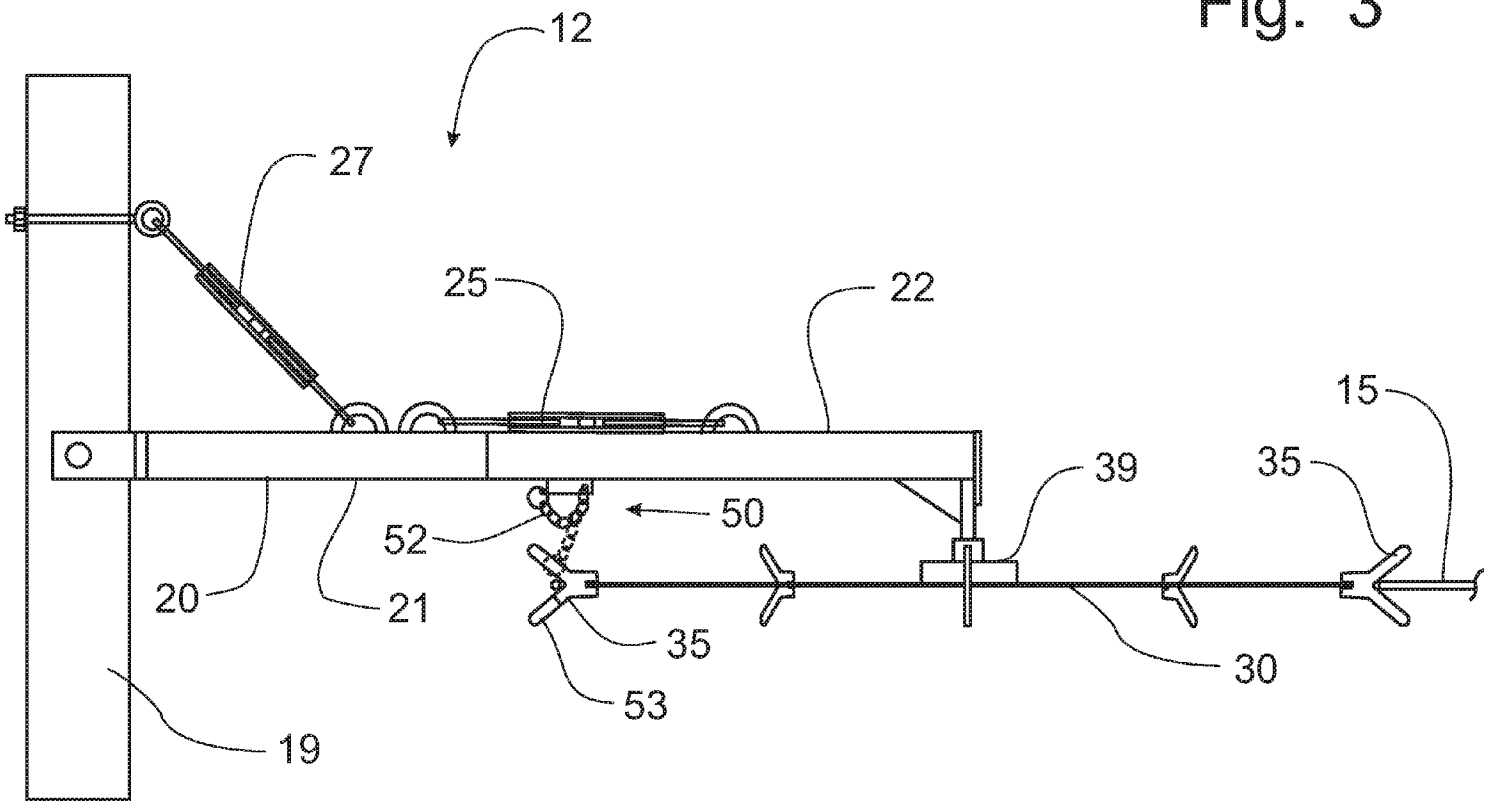
FIG. 3 is an enlarged right side elevational view of the tension pulley forming a part of the clothes line system shown in FIG. 1.
Figure 5:
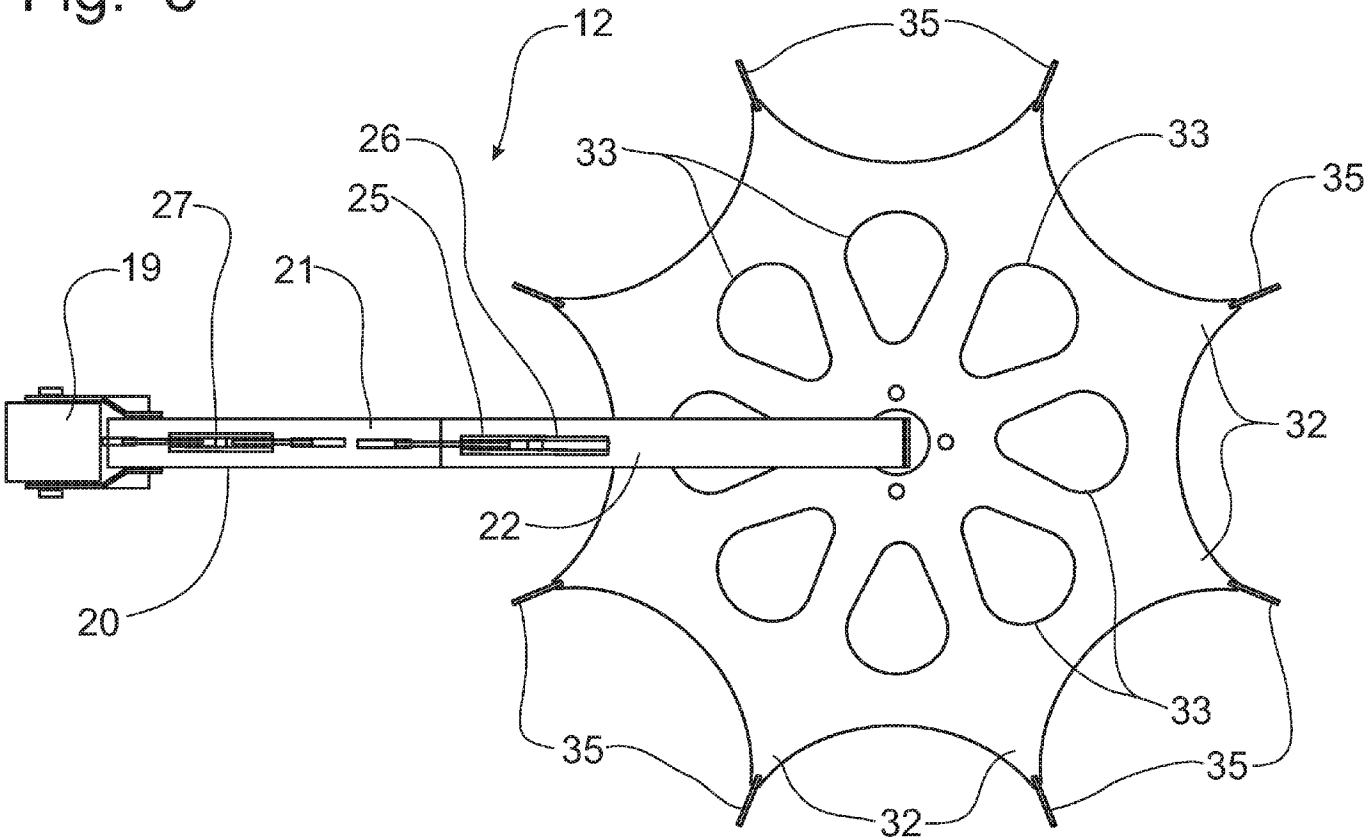
FIG. 5 is a top plan view of the tension pulley depicted in FIG. 3.

The operative end 12 is best seen in FIGS. 3 and 5 and includes the turning pulley 30 rotatably supported from the cantilevered end of a support arm 20 mounted to a vertical post 19 that positions the turning pulley 30 at a sufficient height above the ground to enable the mounting of clothes onto the clothes line 15, as will be described in greater detail below. The cantilevered support arm 20 is preferably formed with a base member 21, preferably formed of square steel tubing, from which extends a slidably mounted telescopic member 22 that are interconnected by a tension adjusting member 25, such as a turnbuckle 26. The tension adjusting member 25 pulls on the telescopic member 22 into the base member 21 to maintain tension on the endless clothes line 15 encircling the turning pulley 30 and the return pulley 40.

Figure 11:
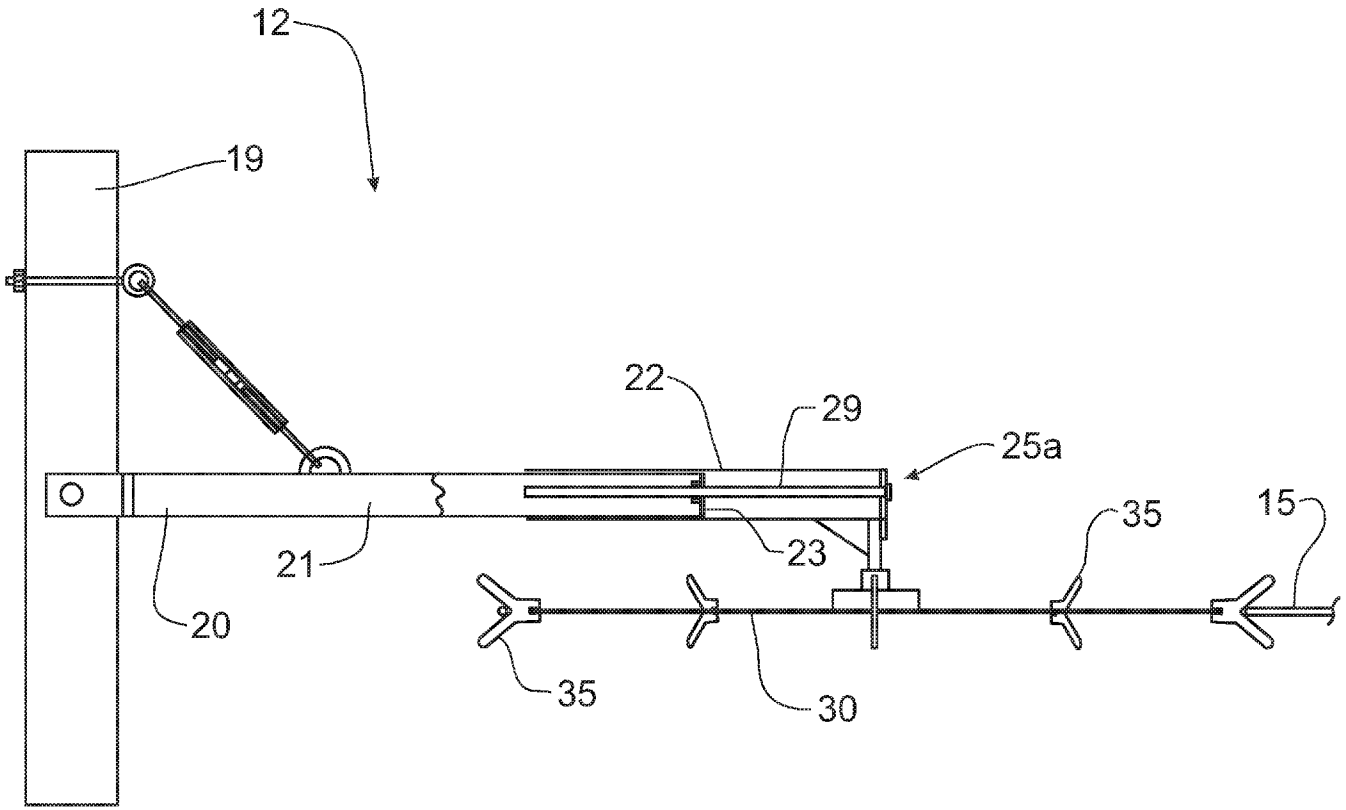
FIG. 11 is a schematic side elevation view of a support post for the tension pulley containing an alternative configuration of a tensioning mechanism.

An alternative tension adjusting member is depicted schematically in FIG. 11, as a draw bolt 29 that pulls the telescopic member 22 toward the base member 21 to maintain tension on the endless clothes line 15. One skilled in the art will note that the draw bolt 29 is threaded into a cap 23 on the base member 21 which slides inside of the telescopic member 22. The threading of the draw bolt 29 will control the position of the telescopic member 22 and the turning pulley 30 which is mounted on the distal end thereof relative to the base member, thereby adjusting the tension in the clothes line 15 entrained around the turning pulley 30 and the return pulley 40 and engaged into the notches 38 of the Y-shaped line engagement members 35 thereon.

The cantilevered support arm 20 is also connected to the vertical post 19 by a tilt adjustment member 27, such as a turn buckle although other forms of adjustment member will be known to one skilled in the art. The purpose of the tilt adjustment member 27, which extends diagonally from the base member 21 to the vertical post 19 above the support arm 20, is to prevent the support arm 20 from sagging with the load of wet clothes being placed onto the clothes line 15 and extending between the turning pulley 30 and the return pulley 40. Furthermore, the tilt adjustment member 27 can be utilized to orient the angle of the support arms 20, 45 in a manner relative to the vertical post 19, 49 so that the clothes line 15 will touch at the center of the upper prong 36 when the clothes line 15 is empty and engage the notch 38 between the prongs 36, 37 when the clothes line 15 is full of wet clothes. Therefore, when the clothes line 15 is loaded with wet clothing, the clothes line 15 will sag and the lower prong 37 will lift the clothes line 15 as the pulleys 30, 40 turn. In operation, the turning pulley 30 is preferably oriented generally horizontally to permit for a convenient loading of wet clothes onto the clothes line 15, as will be described in greater detail below.

The turning or tensioning pulley 30 is preferably formed from a piece of sheet steel into a configuration as shown in FIGS. 3 and 5. The general shape of the turning pulley 30 is circular, but the outer circumference is scalloped to create spokes 32 projecting radially from between the adjacent scalloped portions. Between the axis of rotation, located at the center of the turning pulley 30 and the outer circumference of the turning pulley 30 where the scalloped portions are located, a number of teardrop shaped cutouts 33 are positioned to reduce the overall weight of the turning pulley 30. Thus, in the configuration best seen in FIG. 5, the spokes 32 can extend radially from the center axis of rotation between the adjacent cutouts 33 to the tip of the spoke 32 formed between adjacent scalloped portions. Alternatively, the cutouts 33 can be positioned between the axis of rotation and the tips of the spokes 32.

The tensioning pulley can be formed with four to eight spokes 32, depending on the desired size of the clothes line system 10, so long as sufficient space extends between adjacent spokes 32 at the outer circumference of the tensioning pulley 30 to permit the loading of wet clothes onto the clothes line 15. It has been found that a turning pulley 30 having a diameter in the range of 50 to 65 inches will provide an adequate distance between Y-shaped line engagement members 35 to hang clothes on the clothes line 15 stretched between the adjacent Y-shaped line engagement members 35 with the smaller diameter pulley having perhaps four or six spokes and the larger diameter pulley having eight spokes.

As is best seen in FIG. 9, each spoke 32 is formed with a welded mounting tab 34 that supports the detachable mounting of a Y-shaped line engagement member 35 oriented vertically with an upper prong 36 projecting upwardly at approximately 45 degrees, and a lower prong 37 projecting downwardly at approximately 45 degrees from horizontal. The upper and lower prongs 36, 37 meet at a V-notch 38 which engages the clothes line 15 as the turning pulley is rotated around the vertical axis of rotation formed by a bearing 39 rotatably supporting the turning pulley 30 from the distal end of the support arm 20. Preferably, the lower prong 37 is provided with a rubber, or other elastomeric material, sleeve 53 that will provide a better gripping surface to turn the tensioning pulley 30, and protect hands from operating the tensioning pulley 30 under cold temperatures.

Figure 4:
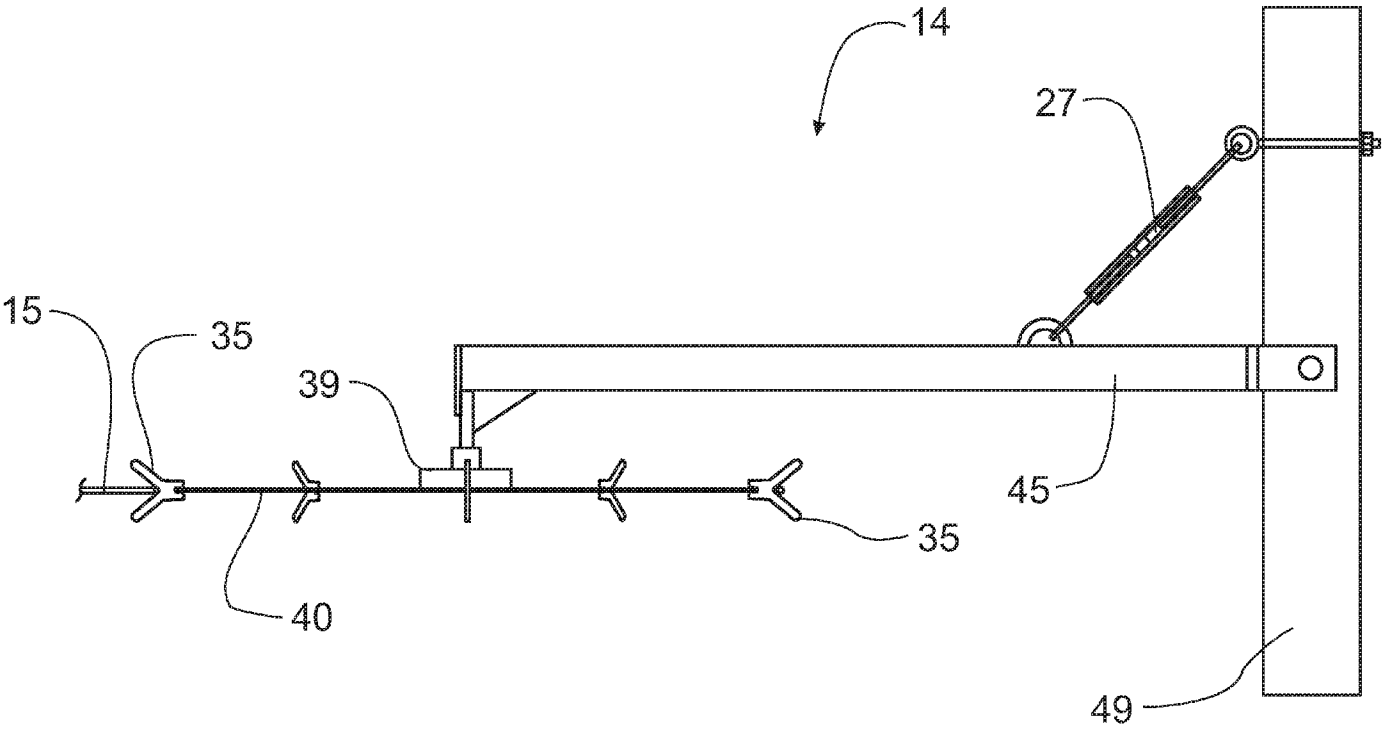
FIG. 4 is an enlarged left side elevational view of the return pulley forming a part of the clothes line system shown in FIG. 1.
Figure 6:
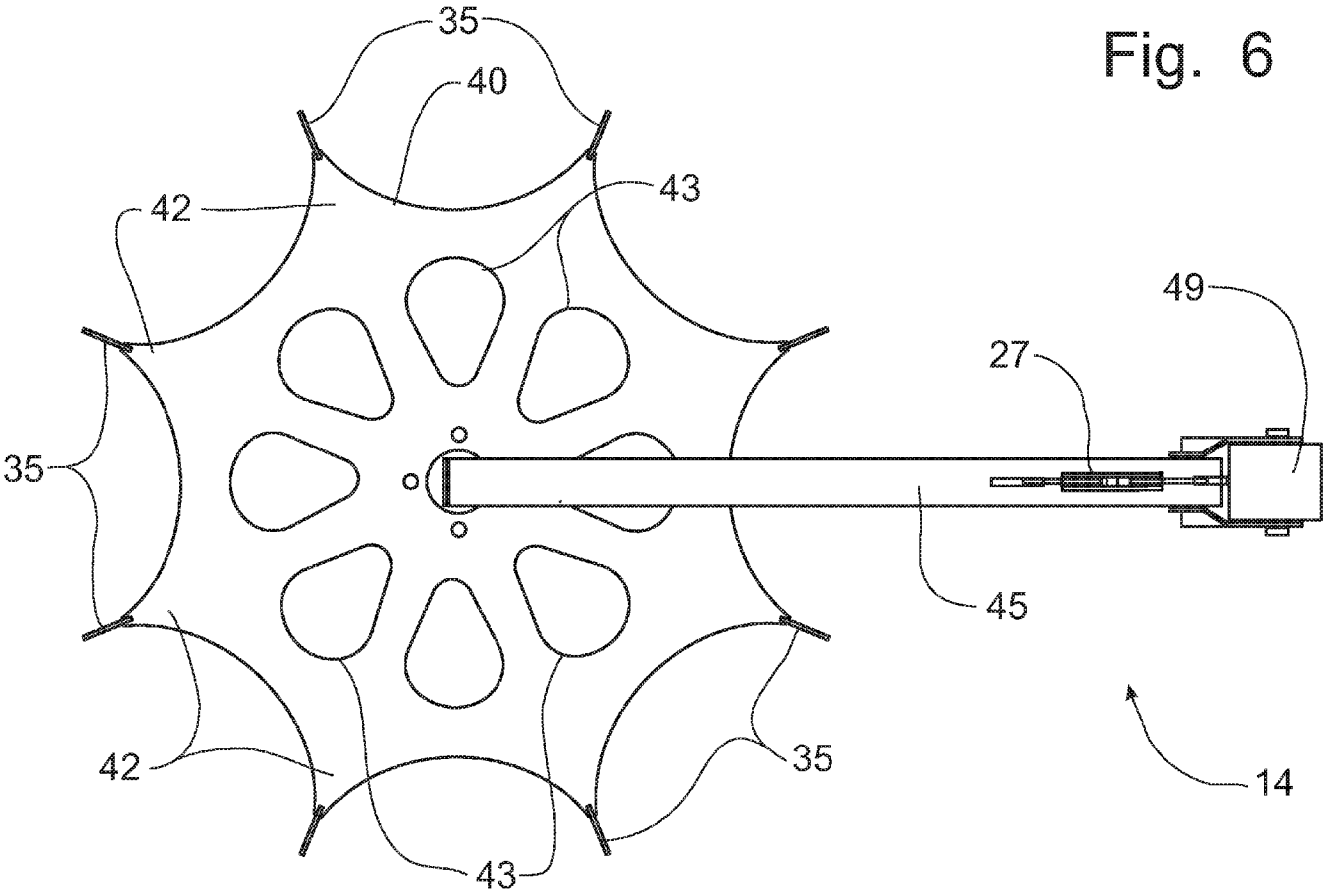
FIG. 6 is a top plan view of the return pulley depicted in FIG. 4.
Figure 7:
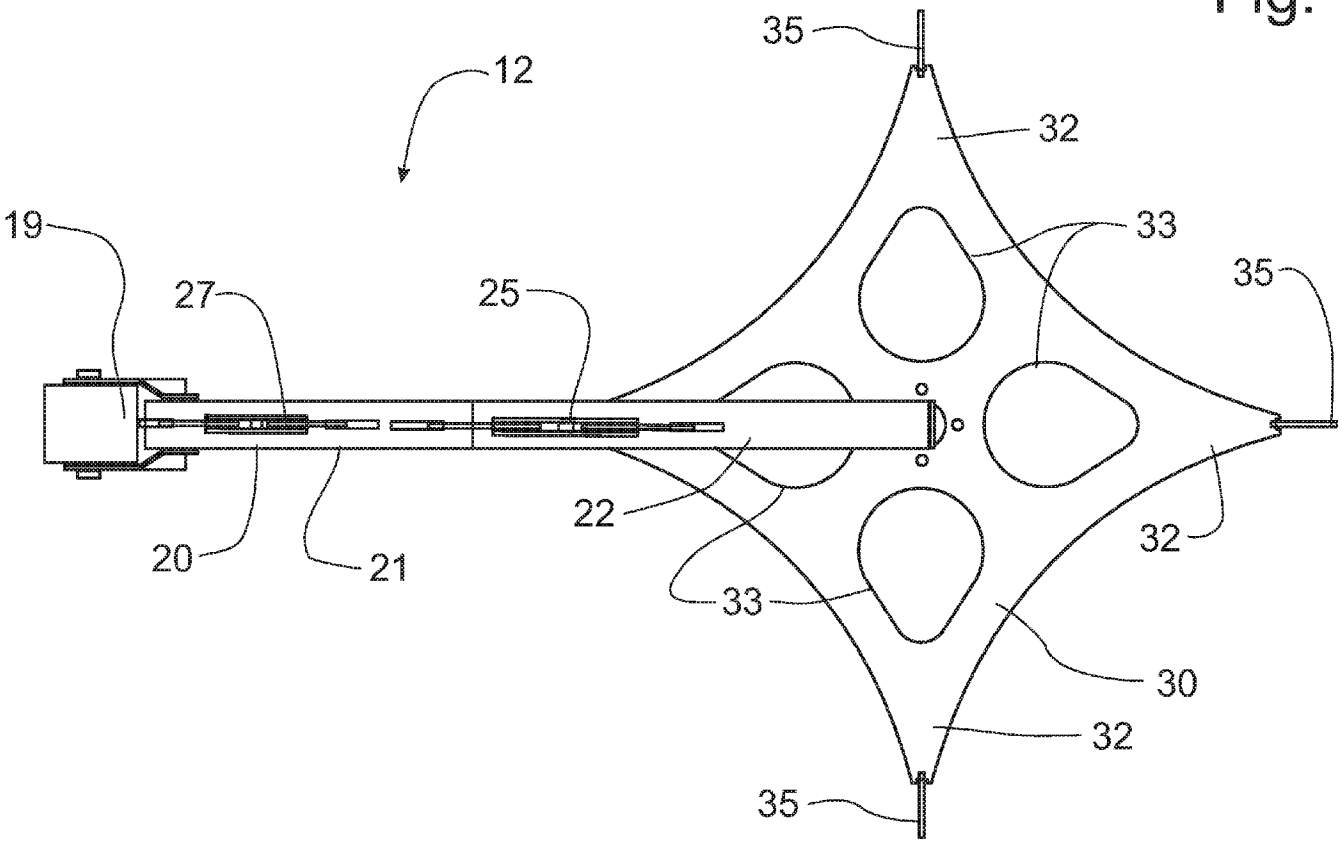
FIG. 7 is a top plan view of an alternative configuration for the tension pulley.
Figure 8:
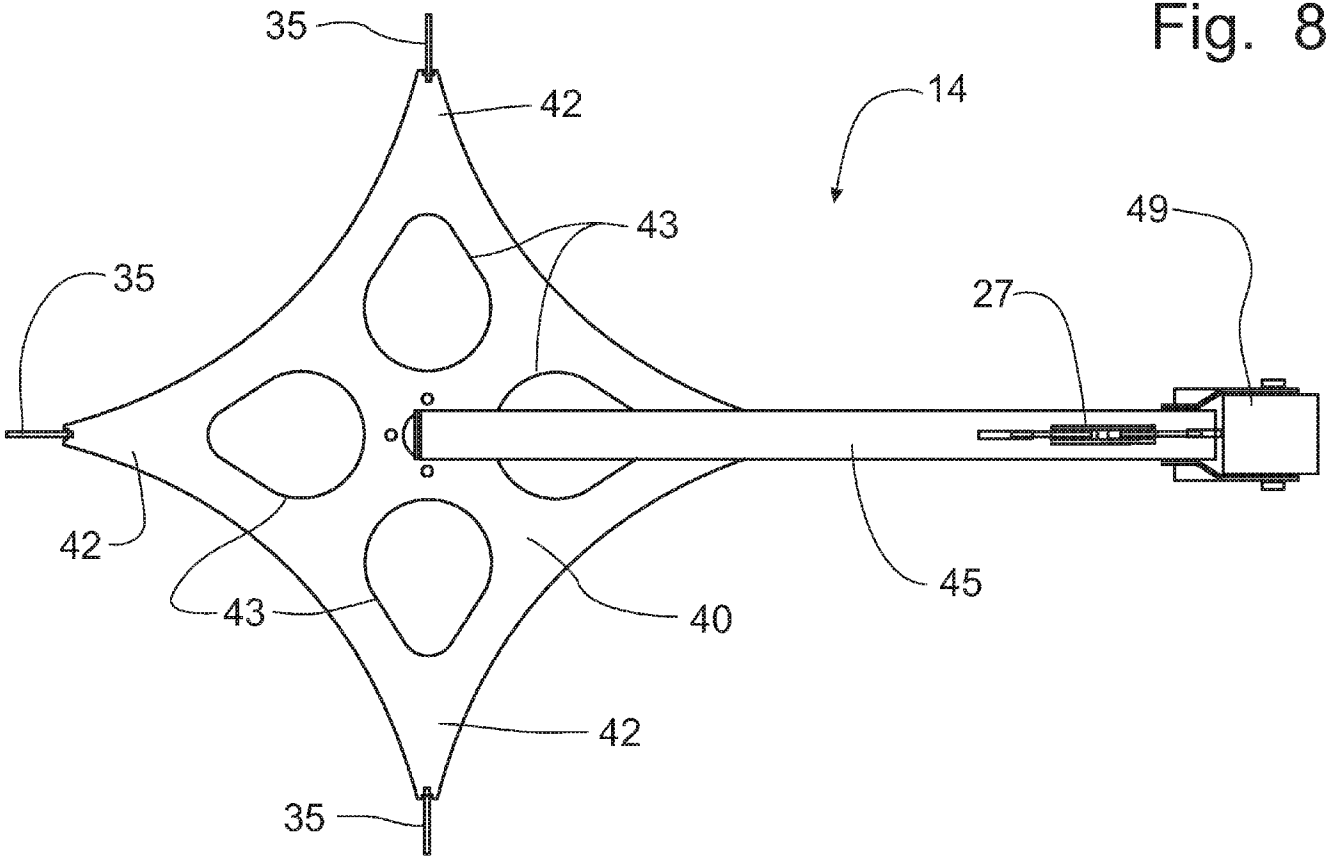
FIG. 8 is a top plan view of an alternative configuration for the return pulley corresponding to the configuration of the tension pulley in FIG. 7.

The return end 14 of the clothes line system 10 is best seen in FIGS. 4 and 6. The return pulley 40 is shaped similarly to the turning pulley 30 with an equal number of spokes 42 as the turning pulley 30, with tear drop shaped cutouts 43 located between respective circumferentially located scalloped portions and the axis of rotation of the return pulley 40. The return pulley 40 is supported from a vertical post 49 by a cantilevered support arm 45 coupled with a tilt adjustment mechanism 27, such as a turnbuckle to maintain the support arm 45 is a horizontal orientation even with a load of wet clothes placed onto the clothes line 15 extending between the turning pulley 30 and the return pulley 40. The primary difference between the mounting of the turning pulley 30 at the operative end 12 and of the return pulley 40 at the return end 14 is that the support arm 45 at the return end 14 does not need to be telescopic as the tension in the clothes line 15 is maintained at the tensioning pulley 30. Accordingly, the support arm 45 at the return end 14 is preferably a single piece of square tubing connected at one end to the vertical post 49 and having a distal end mounting a bearing 39 rotatably supporting the return pulley 40 in the same manner as at the turning pulley 30.

Once mounted on the opposing vertical posts 19, 49, the operative end 12 and the return end 14 are interconnected by an endless loop of clothes line 15. The clothes line 15 should preferably have a length that is a multiple of the linear distance of the gap between adjacent Y-shaped line engagement members 35 to facilitate the synchronization of the turning pulley 30 and the return pulley 40. Synchronization of the pulleys 30, 40, means that the clothing hung on the clothes line 15 between the Y-shaped line engagement members 35 on the tensioning or turning pulley 30 should end up between Y-shaped line engagement members 35 on the return pulley 40. There are several factors that create this synchronization.

One factor is that the orientation of the two pulleys 30, 40 need to be substantially identical at initiation of operation. Also, the length of the clothes line 15 needs to be substantially a multiple of the linear distance between adjacent Y-shaped line engagement members 35 on a pulley 30, 40. Lastly, proper adjustment of the tension in the clothes line 15 by manipulating the tension adjusting members 25, 29 will aid in the proper synchronization of the turning and return pulleys 30, 40 such that the Y-shaped line engagement members 35 on the return pulley 40 engage the clothes line 15 at approximately the same location as the Y-shaped line engagement members 35 on the turning pulley 30. Perfect accuracy in the striking of the Y-shaped line engagement members 35 on the clothes line 15 is not likely to happen, and, in fact, is not really desirable, as hitting the same spot on the clothes line 15 could result in excessive wear on the clothes line 15. With usage, the two pulleys 30, 40 will fall out of synchronization beyond tolerable limits and will need to be adjusted by loosening the clothes line 15 from around the pulleys 30, 40 and turning the adjacent pulley 30, 40 to a position that is oriented substantially the same as the other pulley 30, 40.

This synchronization enables the clothes to be hung between the Y-shaped line engagement members 35 on the tensioning or turning pulley 30 and then fit between the Y-shaped line engagement members 35 on the return pulley 40. This synchronization enables the clothes line system 10 to be utilized with standard clothes pins that connect the wet clothes directly to the clothes line 15, and further enables the clothes to make a complete revolution around the apparatus 10 so that the first clothes placed on the clothes line 15 will be the first clothes removed from the clothes line 15. One skilled in the art will recognize that the clothes line 15 would need to be fabricated from a material that has minimal stretch, such as a stainless steel cable.

Once the clothes line system 10 is meant to be inactive, such as when the clothes line system 10 is not being used, or particularly when the clothes line system 10 is filled with wet clothes and needs to be held stationary, the operative end 12 of the system 10 can be provided with a chain latch mechanism 50, best seen in FIG. 10, to interengage the support arm 20 and the turning pulley 30 to prevent the turning pulley 30 from rotating. The chain latch mechanism 50 includes a bracket 51 secured, such as by welding, to the underside of the telescopic end 22 of the support arm 20. A chain 52, or other similar restraining device, is connected to the bracket 51 at one end and is formed with a loop that will fit over the upper prong 36. Once fitted over the upper prong 36, the chain 52 will limit the rotation of the turning pulley 30, and thus the entire clothes line system 10. When inactive, the loop at the end of the chain 52 hangs on a hook built into the bracket 51 until needed to restrain rotation of the turning pulley 30.

To set up operation of the clothes line system 10, the two pulleys 30, 40 are mounted on vertical posts 19, 49 that are a preselected distance apart, for example sixth-five feet apart. The length of the endless loop of clothes line 15 needs substantially to be a multiple of the distance between the adjacent Y-shaped line engagement members 35. The tilt adjustment members 27 need to be adjusted to position the angle of the support arms 20, 45 so that the clothes line 15 rides about half way up the upper prongs 36 at the side of the pulleys 30, 40 farthest from the respective support arms 20, 45, when the clothes line 15 is unloaded. Then, with the two pulleys 30, 40 are oriented substantially identically; the clothes line system 10 is ready to be operated. When the clothes line 15 is loaded with wet clothes, the clothes line 15 should ride in the notch 38 in the respective Y-shaped line engagement members 35, or at least the Y-shaped line engagement members 35 closest to the support arms 20, 45 as the pulleys 30, 40 rotate.

In operation, the wet clothes are mounted on the clothes line 15 where the clothes line 15 is stretched between two adjacent Y-shaped line engagement members 35. The wet clothes are attached to the clothes line 15 by conventional clothes pins, so long as the clothes pins and the wet clothes are positioned between the two Y-shaped line engagement members 35. With the clothes line 15 pulled tightly between the Y-shaped line engagement members 35 at the rearward half of the turning pulley 30, the clothes line 15 does not move relative to the turning pulley 30 and wet clothes can be safely mounted onto the clothes line 15 at any point along the rearward half of the turning pulley 30. Once the wet clothes have been properly hung on the clothes line 15, the operator pushes the upper and/or lower prongs 36, 37 to cause the turning pulley to rotate sufficiently to present the next section of clothes line 15 between adjacent Y-shaped line engagement members 35.

The wet clothes are continually hung onto the clothes line with each piece of wet clothes to be dried placed successively between the adjacent Y-shaped line engagement members 35. As more clothes are hung on the clothes line 15, the first piece of clothing hung on the clothes line 15 approaches the return pulley 40, leaving the turning pulley 30. In the event a piece of wet clothing to be mounted on the clothes line 15 is larger than the spacing between adjacent Y-shaped line engagement members 35, such as a bed sheet, the clothing would be placed under the lower prong 37 of the corresponding Y-shaped line engagement member(s) 35 leaving a significantly large gap between the Y-shaped line engagement member 35 and the clothing looped under the Y-shaped line engagement member 35 that the subsequent Y-shaped line engagement member 35 on the return pulley 40 will not engage the clothing when the Y-shaped line engagement member 35 on the return pulley 40 engages the clothes line 15.

Ultimately, the wet clothes reach the return pulley 40, whether due to the amount of clothes being hung on the clothes line 15 or the continual turning of the clothes line to bring the first clothes hung on the clothes line 15 back around the return pulley 40 to the turning pulley 30 so as to be the first clothes removed from the clothes line 15. The Y-shaped line engagement members 35 on the return pulley 40 engage the clothes line 15 at approximately the same position as the Y-shaped line engagement members 35 on the turning pulley 30, due to the aforementioned synchronization, which enables the clothes pins connecting the clothes to the clothes line 15 to be positioned between the Y-shaped line engagement members 35 on the return pulley 40. Thus, both runs of the clothes line 15 between the tensioning pulley 30 and the return pulley 40 can be utilized to hang clothing for drying.

The turning pulley 30 is easily rotated by pushing the Y-shaped line engagement members 35 to spin slowly the turning pulley 30. The rotation of the turning pulley 30, through the tension placed in the clothes line 15, causes the clothes line 15 and the return pulley 40 to rotate as well. In this manner, the first clothes hung on the clothes line 15 will return to the turning pulley 30 to become the first clothes to be removed from the clothes line 15.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A clothes line system, comprising:

first and second spaced apart support posts;

a horizontal tensioning pulley rotatably supported from said first support post;

a horizontal return pulley rotatably supported from said second support post, each of said tensioning pulley and said return pulley being configured with a plurality of spokes terminating in radially extending Y-shaped line engagement members;

an endless clothes line entrained around said tensioning pulley and said return pulley engaged with said Y-shaped line engagement members on each respective said pulley, said endless clothes line having a length being approximately equal to a multiple of a linear distance between adjacent Y-shaped line engagement members such that articles can be directly hung on said clothes line between adjacent Y-shaped line engagement members on said tensioning pulley to be operable to return from around the opposing return pulley and be located between said adjacent Y-shaped line engagement members on said tensioning pulley, said Y-shaped members on both said tensioning pulley and said return pulley engaging said clothes line at approximately the same location, thus preventing the Y-shaped line engagement members on either respective pulley from engaging the articles hung on said clothes line;

each said Y-shaped line engagement member being formed with an upper prong and a lower prong forming a notch at the intersection between said upper and lower prongs, said clothes line being entrained around said tensioning and return pulleys within the notches in said Y-shaped line engagement members, each said Y-shaped line engagement member being detachably mounted on the respective said pulley; and a tension adjustment mechanism operable to adjust the distance between said tensioning pulley and said return pulley to maintain tension in the clothes line and the synchronization of said tensioning pulley and said return pulley.

2. The clothes line system of claim 1 wherein said tensioning pulley is rotatably supported on a distal end of a first support arm connected to said first support post, said return pulley being rotatably supported on a distal end of a second support arm connected to said second support post.

3. The clothes line system of claim 2 wherein said first support arm is formed with a base member connected to said first support post and a telescopic member mounted on said base member and being movable relative thereto, said tensioning pulley being rotatably supported on the distal end of said telescopic member, said tension adjustment mechanism interconnecting said base member and said telescopic member to control the position of said telescopic member relative to said base member, and thereby control the distance between said tensioning pulley and said return pulley.

4. The clothes line system of claim 3 wherein each said support arm includes a tilt adjustment mechanism interconnecting each respective said support arm and the corresponding support post, each said tilt adjustment mechanism controlling the attitude of the corresponding support arm to position the tensioning and return pulleys to aid in synchronization.

5. A clothes line system, comprising:

first and second spaced apart support posts;

a horizontal tensioning pulley rotatably supported from said first support and a horizontal return pulley rotatably supported from said second support post, each of said tensioning pulley and said return pulley being configured with a plurality of spokes terminating in radially extending Y-shaped line engagement members, said adjacent Y-shaped line engagement members having a linear distance dimension therebetween, said first support arm being formed with a base member connected to said first support post and a telescopic member mounted on said base member and being movable relative thereto, said tensioning pulley being rotatably supported on a distal end of said telescopic member;

each said Y-shaped line engagement member being formed with an upper prong and a lower prong forming a notch at the intersection between said upper and lower prongs with said clothes line being entrained around said tensioning and return pulleys within the notches in said Y-shaped line engagement members, each said Y-shaped line engagement member being detachably connected to the respective said tensioning and return pulleys;

an endless clothes line entrained around said tensioning pulley and said return pulley engaged with said Y-shaped line engagement members on each respective said pulley, said endless clothes line having a length that is approximately a multiple of said linear distance between adjacent Y-shaped line engagement members, such that articles can be hung directly on said clothes line between adjacent Y-shaped line engagement members on said tensioning pulley and be positioned to be located between said adjacent Y-shaped line engagement members on said return pulley and upon return from around the opposing return pulley between the Y-shaped line engagement members on said tensioning pulley and, thereby, establish synchronization of said tensioning pulley and said return pulley such that the Y-shaped engagement members on said return pulley engage said clothes line at approximately the same location that the corresponding Y-shaped engagement members; and a tension adjustment mechanism operable to adjust the distance between said tensioning pulley and said return pulley to maintain the tension within said clothes line, said tension adjustment mechanism interconnecting said base member and said telescopic member to control the position of said telescopic member relative to said base member, and thereby control the distance between said tensioning pulley and said return pulley, said tension adjusting mechanism comprising a turnbuckle interconnecting said base member and said telescopic member of said first support arm.

6. The clothes line system of claim 5 wherein said tensioning pulley is rotatably supported on a distal end of a first support arm connected to said first support post, said return pulley being rotatably supported on a distal end of a second support arm connected to said second support post.

7. The clothes line system of claim 5 wherein each said support arm includes a tilt adjustment mechanism interconnecting each respective said support arm and the corresponding support post, each said tilt adjustment mechanism controlling the attitude of the corresponding support arm to position the tensioning and return pulleys to aid in synchronization.

8. The clothes line system of claim 7 wherein said tilt adjustment mechanism is a turnbuckle.

9. A clothes line system, comprising:

first and second spaced apart support posts;

a horizontal tensioning pulley rotatably mounted at a distal end of a first support arm extending generally horizontally from said first support post, said tensioning pulley being formed from a single piece of sheet metal having a scalloped outer circumference forming a predetermined number of radially extending spokes;

a horizontal return pulley rotatably mounted at a distal end of a second support arm extending generally horizontally from said second support post, said return pulley being formed from a single piece of sheet metal having a scalloped outer circumference forming a number of radially extending spokes equal to the number of spokes on said tensioning pulley;

each of said spokes on said tensioning pulley and said return pulley terminating in radially extending Y-shaped line engagement members, each pair of adjacent Y-shaped line engagement members having a linear distance dimension therebetween, each said Y-shaped line engagement member being formed with an upper prong and a lower prong forming a notch at the intersection between said upper and lower prongs with said clothes line being entrained around said tensioning and return pulleys within the notches in said Y-shaped line engagement members, each said Y-shaped line engagement member being detachably connected to the respective said tensioning and return pulleys;

an endless clothes line entrained around said tensioning pulley and said return pulley engaged with said Y-shaped line engagement members on each respective said pulley, said endless clothes line having a length that is approximately a multiple of said linear distance between adjacent Y-shaped line engagement members, said endless clothes line having a length being approximately equal to a multiple of said linear distance dimension between adjacent Y-shaped line engagement members, such that articles can be hung directly on said clothes line between adjacent Y-shaped line engagement members on said tensioning pulley and be positioned to be located between said adjacent Y-shaped line engagement members on said return pulley and upon return from around the opposing return pulley between the Y-shaped line engagement members on said tensioning pulley, thereby establishing synchronization between said tensioning pulley and said return pulley such that the Y-shaped line engagement members on said return pulley engage said clothes line at approximately the same location that the corresponding Y-shaped line engagement members engaged said clothes line at the tensioning pulley, thus preventing the Y-shaped line engagement members on either respective pulley from engaging articles hung on said clothes line; and a tension adjustment mechanism operable to adjust the distance between said tensioning pulley and said return pulley to effect and to maintain tension in said clothes line.

10. The clothes line system of claim 9 wherein said first support arm is formed with a base member connected to said first support post and a telescopic member mounted on said base member and being movable relative thereto, said tensioning pulley being rotatably supported on the distal end of said telescopic member, said tension adjustment mechanism interconnecting said base member and said telescopic member to control the position of said telescopic member relative to said base member, and thereby control the distance between said tensioning pulley and said return pulley.

11. The clothes line system of claim 10 wherein said tension adjusting mechanism comprises a turnbuckle interconnecting said base member and said telescopic member of said first support arm.

12. The clothes line system of claim 10 wherein said tension adjusting mechanism comprises:

a cap mounted on a distal end of said base member; and a draw bolt engaged with a distal end of said telescopic member, said draw bolt being threaded into said cap whereby a turning of said draw bolt changes the distance between the distal end of said base member and the distal end of said telescopic member.

13. The clothes line system of claim 10 wherein each said support arm includes a height adjustment mechanism interconnecting each respective said support arm and the corresponding support post, each said height adjustment mechanism controlling the attitude of the corresponding support arm to position the tensioning and return pulleys in a horizontal orientation.

* * * * *